US007571807B2

(12) United States Patent
DeBusk et al.

(10) Patent No.: US 7,571,807 B2
(45) Date of Patent: Aug. 11, 2009

(54) CARTON WITH DISPLAY FEATURES

(75) Inventors: Patrick J. DeBusk, Larue, TX (US); Andrea Coltri-Johnson, Acworth, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 225 days.

(21) Appl. No.: 11/361,454

(22) Filed: Feb. 24, 2006

(65) Prior Publication Data

US 2006/0231439 A1 Oct. 19, 2006

Related U.S. Application Data

(60) Provisional application No. 60/656,240, filed on Feb. 25, 2005.

(51) Int. Cl.
*B65D 5/00* (2006.01)

(52) U.S. Cl. ..... 206/435; 206/775; 206/756

(58) Field of Classification Search ..... 206/427, 206/193, 429, 430, 433, 434, 435, 775, 779, 206/756, 757, 761
See application file for complete search history.

(56) References Cited

U.S. PATENT DOCUMENTS

| | | | | |
|---|---|---|---|---|
| 2,676,731 | A * | 4/1954 | Klein | 206/183 |
| 3,132,744 | A | 5/1964 | Scharf | |
| 3,315,803 | A * | 4/1967 | Kalajian | 206/216 |
| 3,578,238 | A * | 5/1971 | Schillinger et al. | 206/427 |
| 3,593,849 | A * | 7/1971 | Helms et al. | 206/427 |
| 3,696,990 | A * | 10/1972 | Dewhurst | 206/427 |
| 4,034,852 | A * | 7/1977 | Forrer | 206/141 |
| 4,375,258 | A * | 3/1983 | Crayne et al. | 206/141 |
| 4,957,202 | A * | 9/1990 | Yoshiki et al. | 206/734 |
| 5,222,658 | A * | 6/1993 | DeMaio et al. | 229/117.13 |
| 5,381,891 | A * | 1/1995 | Harris | 206/197 |
| 6,241,083 | B1 * | 6/2001 | Harrelson | 206/141 |
| 7,059,494 | B2 | 6/2006 | Harrelson et al. | |

FOREIGN PATENT DOCUMENTS

| | | |
|---|---|---|
| DE | 7120656 | 11/1971 |
| GB | 869380 | 5/1961 |

* cited by examiner

*Primary Examiner*—Jacob K Ackun, Jr.
(74) *Attorney, Agent, or Firm*—Womble Carlyle Sandridge & Rice, PLLC

(57) ABSTRACT

A carton includes display patterns that allow containers and other articles to be displayed at an exterior of the carton.

26 Claims, 9 Drawing Sheets

CARTON WITH DISPLAY FEATURES

RELATED APPLICATIONS

This application claims the benefit of U.S. Provisional Application No. 60/656,240, filed Feb. 25, 2005, the entire contents of which are hereby incorporated by reference.

BACKGROUND

Enclosed cartons with dispensing features have been used in the past. Many of these cartons include a dispenser defined by tear lines. The dispenser is removable from the carton to create an opening through which articles can be removed from the carton. Such dispensers, however, provide little or no visibility of the containers held within the carton.

SUMMARY

According to a first exemplary embodiment of the invention, a carton comprises a top panel, a first side panel, a second side panel, a bottom panel, a first end panel, a second end panel, and at least one display pattern. The display pattern defines display panels that can be partially separated from a side panel and the top panel along the display pattern. The display panels can be pressed into the carton interior to form a display receptacle. Articles can be mounted in a display receptacle for display so that they are visible from the carton exterior.

According to one aspect of the first exemplary embodiment, the carton can include, for example, a plurality of display patterns. The display patterns can be disposed along one or both of the first and second sides of the carton, and can be constructed to support articles at different heights and/or spacings. The display patterns therefore provide a variety of display options.

According to another aspect of the first exemplary embodiment, the carton can include a dispenser through which articles accommodated within the carton can be removed before display in the display receptacles.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present invention generally relates to cartons having display features that allow articles such as containers to be displayed on the exterior of a carton. The present invention can be used, for example, in cartons that contain articles or other products such as, for example, food and beverages. The articles can also include beverage containers such as, for example, cans, bottles, petaloid bottle containers, or other containers such as those used in the packaging of foodstuffs.

For the purposes of illustration and not for the purpose of limiting the scope of the invention, the following detailed description describes beverage container cans as disposed within and displayed in the carton embodiments. In this specification, the terms "lower," "bottom," "upper" and "top" indicate orientations determined in relation to fully erected cartons placed in their display configurations.

Figure 1:
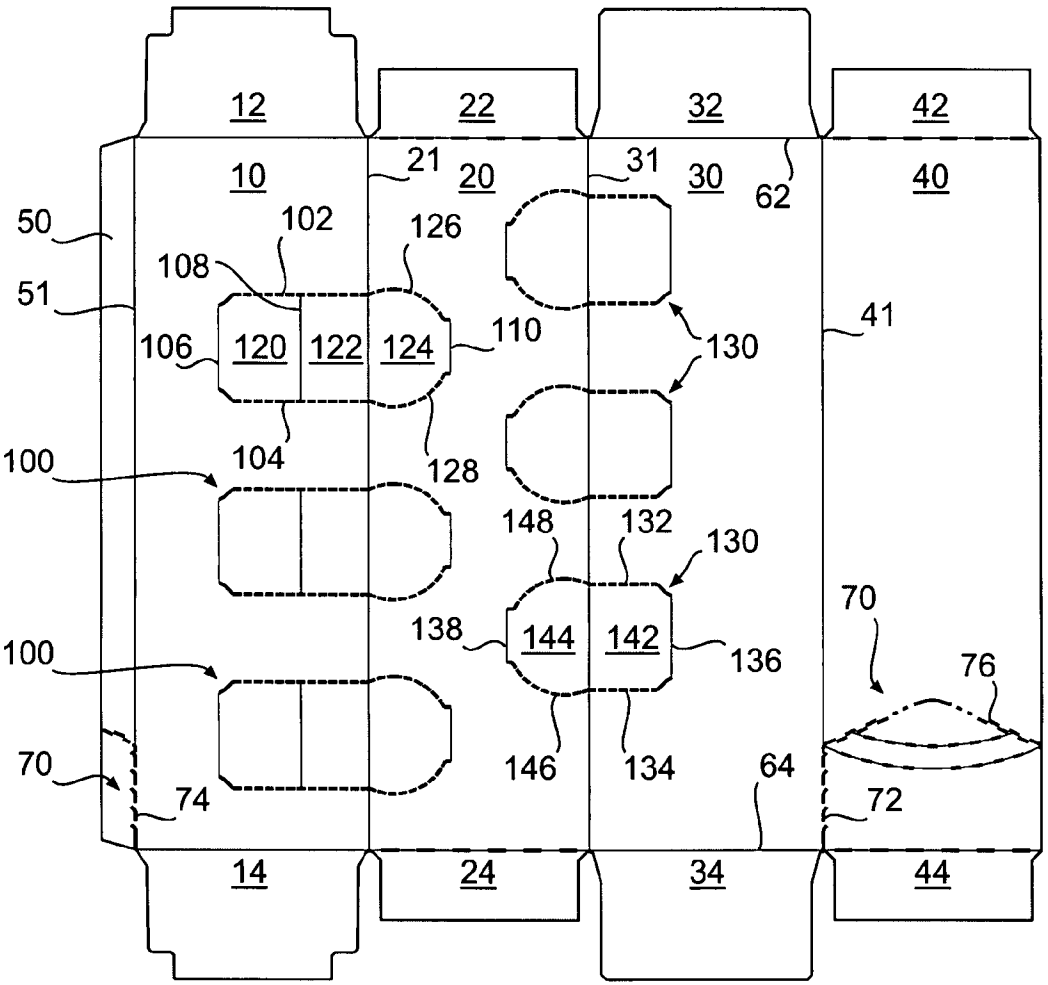
FIG. 1 is a plan view of a blank used to form a carton having display features according to a first embodiment of the invention.

FIG. 1 is a plan view of a blank 8 used to form a carton 190 (illustrated in FIG. 2) according to a first embodiment of the invention. The carton blank 8 comprises a first side panel 10 foldably connected to a top panel 20 at a first transverse fold line 21, a second side panel 30 foldably connected to the top panel 20 at a second transverse fold line 31, and a bottom panel 40 foldably connected to the second side panel 30 at a third transverse fold line 41. An adhesive flap 50 can be foldably connected to the first side panel 50 at a fifth transverse fold line 51. The first side panel 10 is foldably connected to first side end flaps 12, 14. The top panel 20 is foldably connected to top end flaps 22, 24. The second side panel 30 is foldably connected to second side end flaps 32, 34. The bottom panel 40 is foldably connected to bottom end flaps 42, 44.

When the carton 190 is erected, the end flaps 12, 22, 32, 42 close a first end of the carton 190, and the end flaps 14, 24, 34, 44 close a second end of the carton 190.

The end flaps 12, 22, 32, 42 extend along a first marginal area of the blank 8, and may be foldably connected at a first longitudinally extending fold line 62 that extends along the length of the blank 8. The end flaps 14, 24, 34, 44 extend along a second marginal area of the blank 8, and may be foldably connected at a second longitudinally extending fold line 64 that extends along the length of the blank 8. The longitudinally extending fold lines 62, 64 may be substantially straight and parallel to one another. The first and second longitudinally extending fold lines 62, 64 may also be offset at one or more locations to account for blank thickness or for other factors, for example. Cuts may be formed at one or more locations along the fold lines 62, 64 to facilitate folding of the end flaps.

Figure 2:
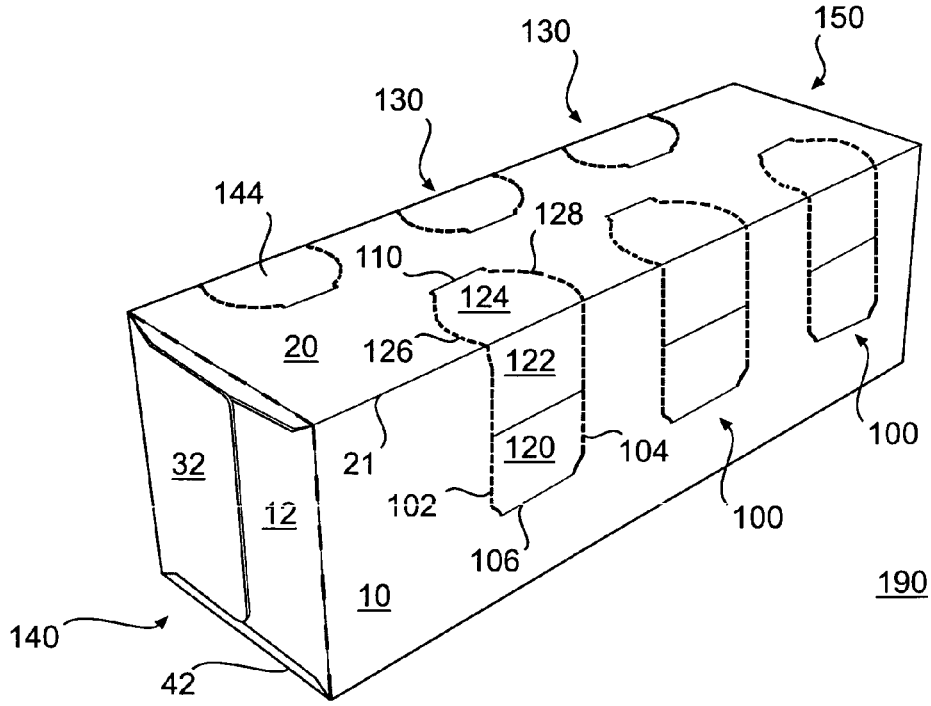
FIG. 2 illustrates the erected carton according to the first embodiment of the invention.

The blank 8 may include a dispenser pattern 70 that may be opened in order to dispense articles from the erected carton 190 (illustrated in FIG. 2). The dispenser pattern 70 comprises first, second and third tear lines 72, 74, 76 that define a dispenser panel 78 primarily in the bottom panel 40. The dispenser pattern 70 is exemplary, and other dispenser patterns may be employed in cartons according to the principles of the present invention.

According to one aspect of the present invention, the carton 190 includes a plurality of display features defined by sets of first and second display patterns 100, 130 of lines of disruption or weakening formed in the blank 8. The blank 8 is illustrated as having three first display patterns 100 arranged generally along the first side panel 10 and the top panel 20, and three second display patterns 130 arranged generally along the second side panel 30 and the top panel 20. The first and second display patterns 100, 130 can be placed in a display configuration that allows articles to be mounted in and displayed at the exterior of the carton 190.

The first display patterns 100 extend through the first side panel 10 and the top panel 20. The first display patterns 100 comprise side tear lines 102, 104 that define opposite sides of the display patterns 100 in the first side panel 10. The side tear lines 102, 104 continue and extend to curved side tear lines 126, 128 in the top panel 20, respectively. Transverse fold lines 106, 108, 21, 110 divide the first display patterns 100 into foldably connected first display panels 120, 122, 124. The first display panels 120, 122, 124 serve to support an article A when the first display patterns 100 are placed in a display configuration.

The second display patterns 130 extend through the second side panel 30 and the top panel 20. The second display patterns 130 comprise side tear lines 132, 134 that define opposite sides of the second display patterns 130 in the second side panel 30.

The side tear lines 132, 134 continue and extend to curved side tear lines 146, 148 in the top panel 20, respectively. Transverse fold lines 136, 138, 31 divide the second display patterns 130 into foldably connected second display panels 142, 144. The display panels 142, 144 act to support an article A when the second display patterns 130 are placed in a display configuration.

The tear lines 102, 104, 126, 128, 132, 134, 146, 148 illustrated in FIG. 1 may be, for example, cuts or tear lines formed from a series of cuts and/or scores, offset cut/space lines, combinations thereof, and other breachable lines of disruption formed in the blank 8. The tear lines are formed to allow the display panels to be pressed into an interior of the erected carton 190. The fold lines 21, 31, 41, 51, 106, 108, 110, 136, 138 may be, for example, fold lines formed from creases, cuts, scores, and combinations thereof.

In one exemplary method of construction, the carton 199 may be erected by gluing or otherwise adhering the upper side of the adhesive flap 50 to the underside of the second side panel 40 so that the panels 10, 20, 30, 40 may be opened to form a generally tubular sleeve. The ends of the tubular sleeve may then be closed by folding and gluing or otherwise adhering the end flaps 12, 22, 32, 42 at one end of the sleeve and the end flaps 14, 24, 34, 44 at the other end of the sleeve. Articles such as, for example, generally cylindrical containers C may be loaded into the tubular sleeve in a conventional manner at any time before one or both ends of the carton are closed by the end flaps 12, 22, 32, 42, 14, 24, 34, 44.

FIG. 2 illustrates the erected carton 190 loaded with containers C (not shown in FIG. 2). In the exemplary first embodiment, the carton 190 encloses twelve can containers C. The containers C are arranged in the carton 190 in a two row and six column (2×6) configuration. In the erected carton 190, the end flaps 12, 22, 32, 42 form a first end panel 140 and the end flaps 14, 24, 34, 44 form a second end panel 150. The dispenser pattern 70 is disposed along the bottom panel 40 and is not shown in FIG. 2.

The first display patterns 100 extend along the top panel 20 and the first side panel 10, and the second display patterns 130 extend along the top panel 20 and the second side panel 30. The first display patterns 100 are generally offset from the second display patterns 130 in the length direction of the carton 190, although other arrangements are within the scope of the invention.

Placement of the carton 190 in a display configuration will now be discussed below with reference to FIGS. 3 and 4. In order to place the carton 190 in a display configuration, the carton 190 may first be opened at the dispenser pattern 70 and one or more of the containers C held within the carton removed.

Figure 3:
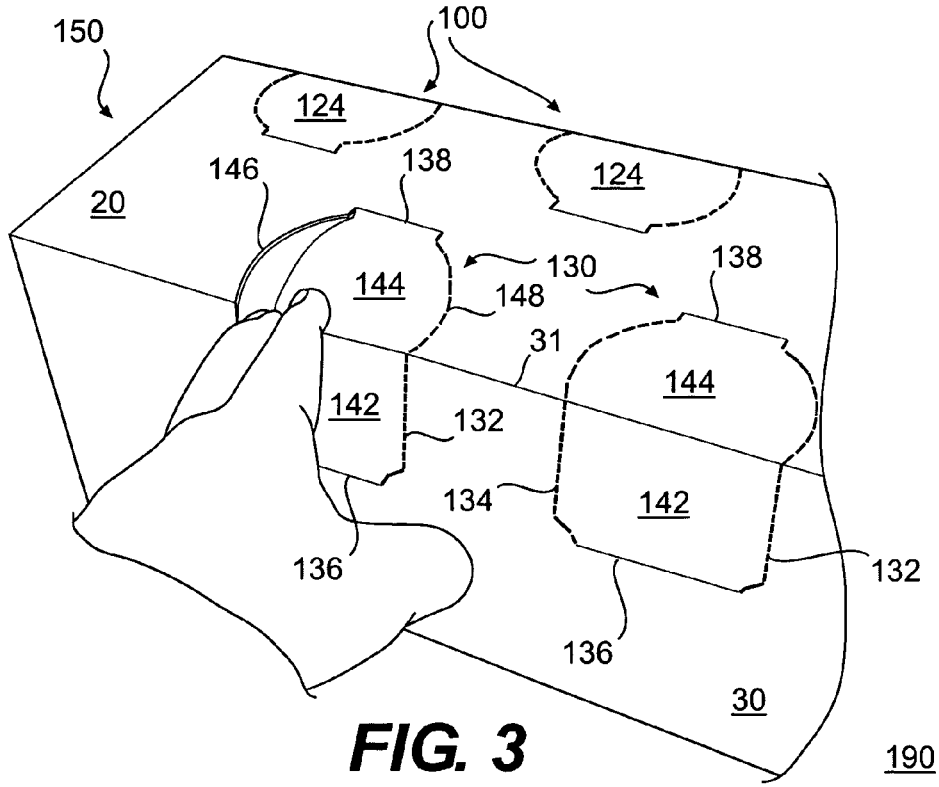
FIG. 3 illustrates a user accessing a display feature in the first carton embodiment.
Figure 4:
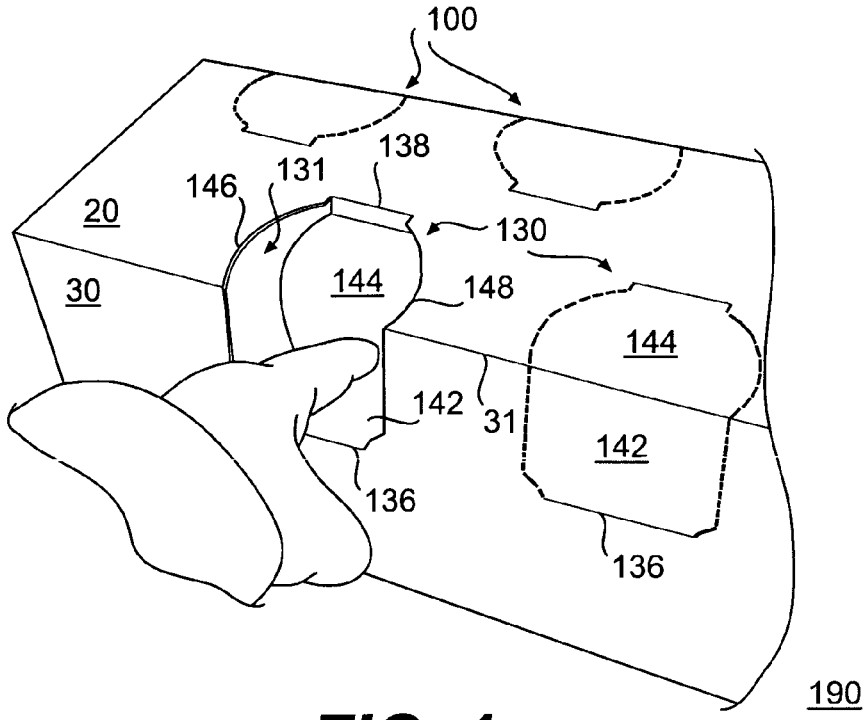
FIG. 4 illustrates a user further accessing a display feature in the first carton embodiment.

FIG. 3 illustrates an initial step of one of the second display patterns 130 being placed in a dispensing configuration. In FIG. 3, a user presses downwardly inside of the periphery of the second display pattern 130 to tear the display pattern along any or all of the tear lines 132, 134, 146, 148. FIG. 4 illustrates the second display pattern 130 being torn along the lines 132, 134, 146, 148. When the carton 190 is pushed inwardly at the display panels 142, 144, the display panels 142, 144 fold inwardly at the fold lines 136, 138, 31 so that they extend into the interior of the carton 190.

Figure 5:
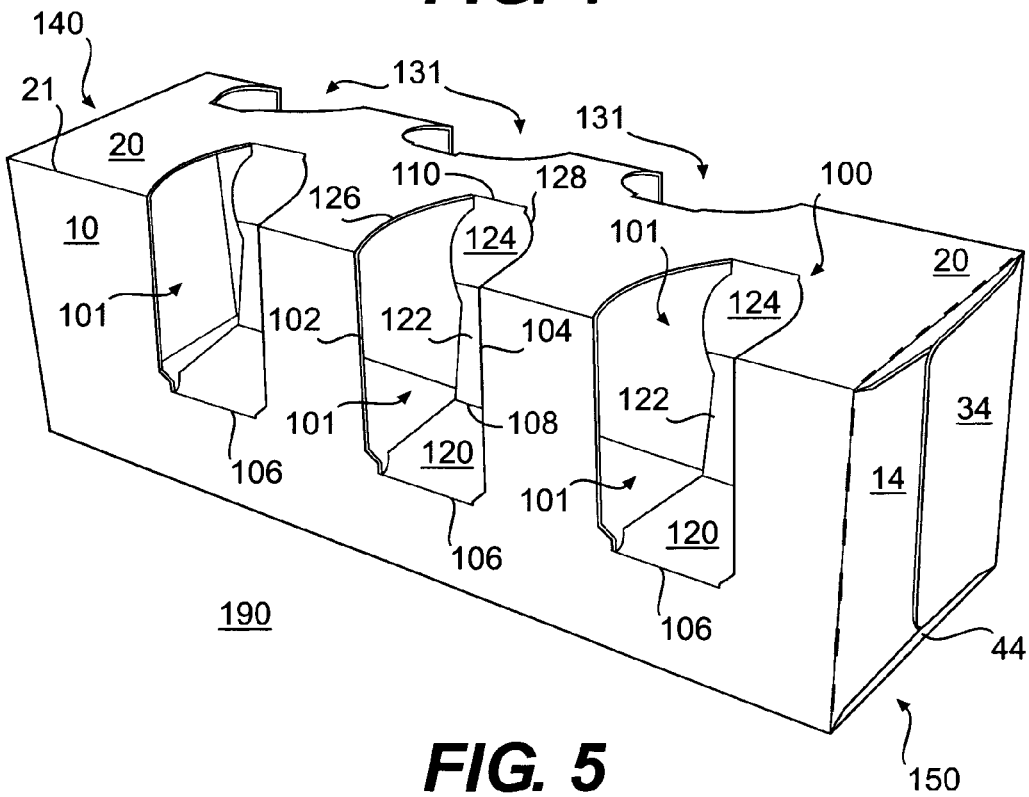
FIGS. 5-7 illustrate the first carton embodiment in a display configuration.
Figure 6:
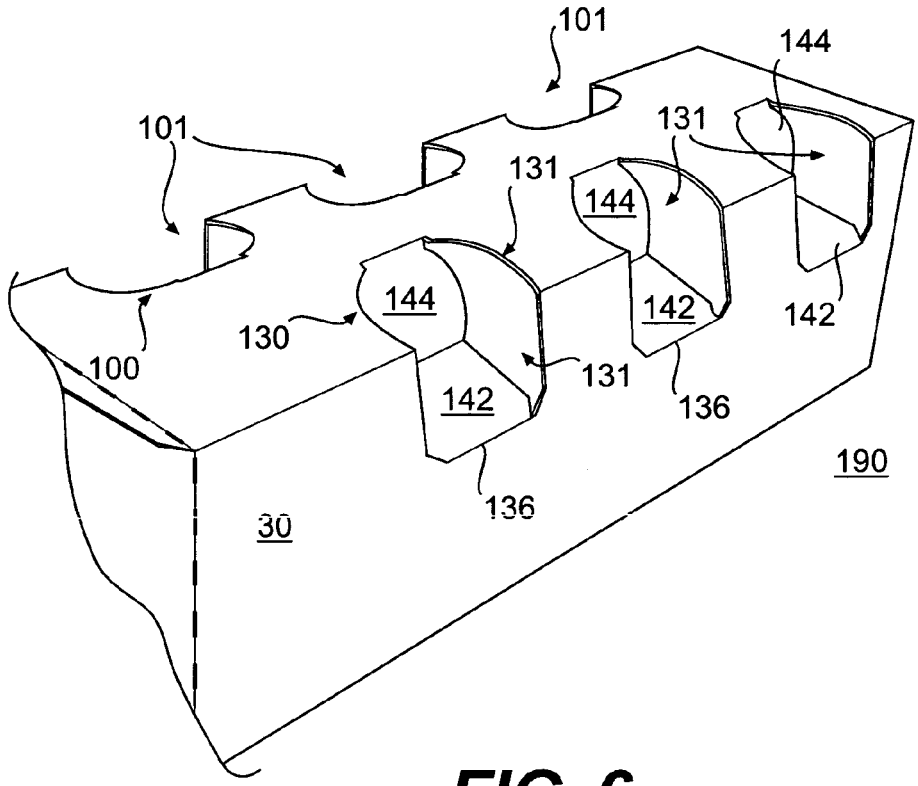
Figure 7:
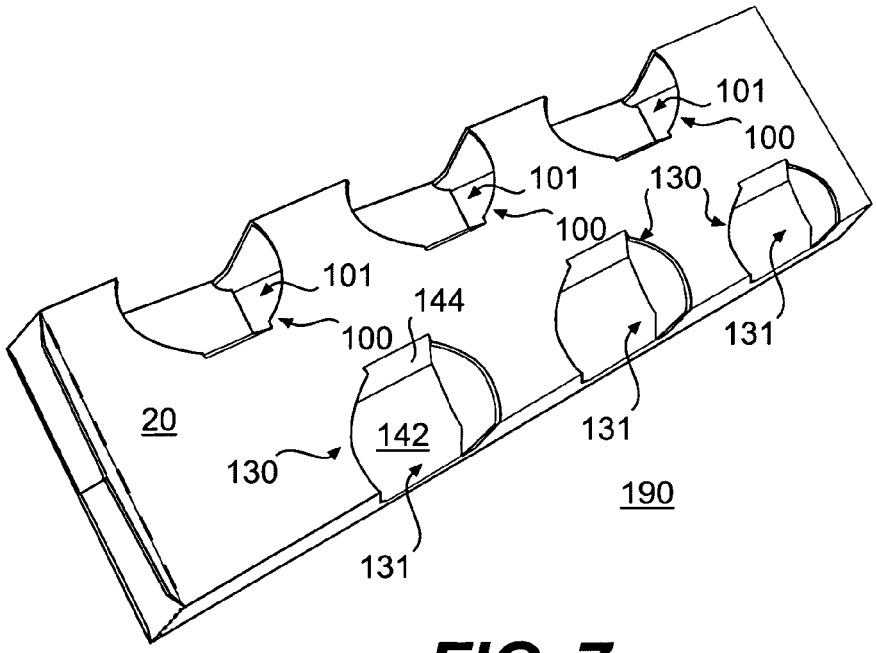

FIGS. 5-7 illustrate the carton 190 with all display patterns 100, 130 placed in their display configurations. The first display patterns 100 are placed in the dispensing configuration by pressing in on the first display panels 120, 122, 124 to tear the first display patterns 100 along the tear lines 102, 104, 126, 128. In their display configurations, the first display patterns 100 form first display receptacles 101, and the second display patterns 130 form second display receptacles 131.

Figure 8:
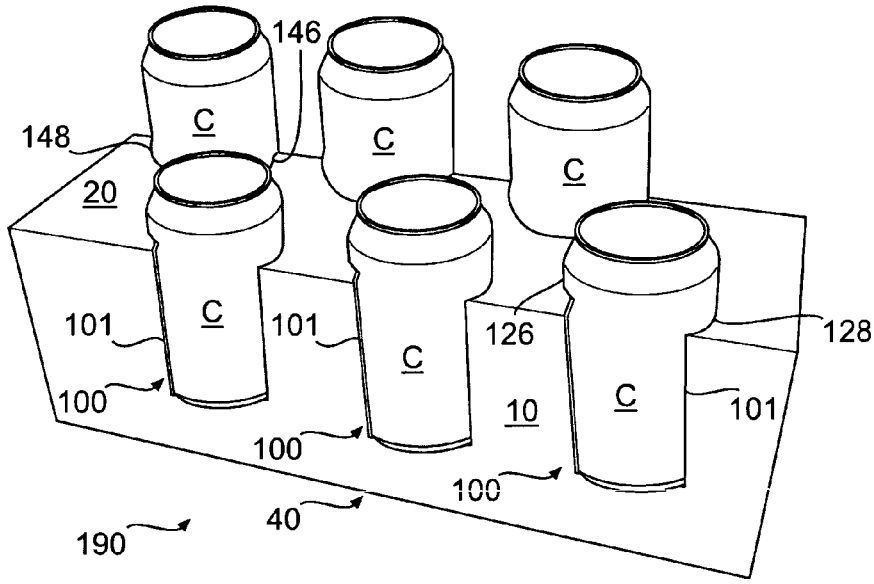
FIGS. 8 and 9 illustrate the first carton embodiment in a display configuration with containers mounted in the display features.
Figure 9:
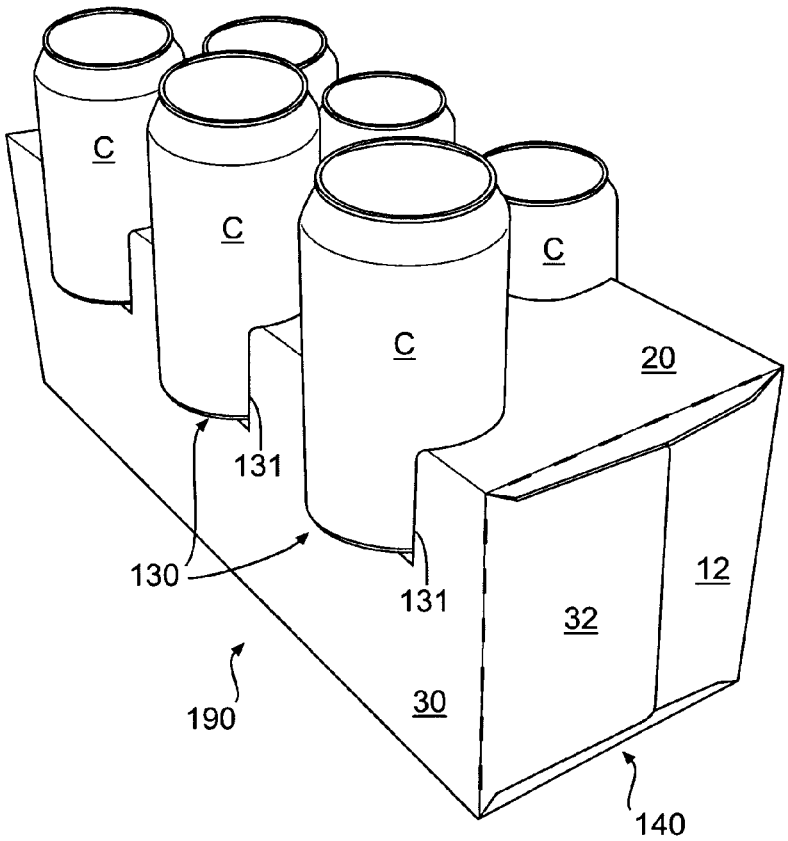

FIGS. 8 and 9 illustrate the first and second display patterns 100, 130 with containers C mounted in the display receptacles 101, 131. In this configuration, the bottoms of the containers C contact the upper surfaces of the display panels 120, 142, which serve as support surfaces. The peripheries of the display receptacles 101, 131 can be, as shown in FIGS. 7 and 8, relatively conforming to the contours of the containers C. For example, the containers C are illustrated as generally cylindrical, and the curved tear lines 126, 128, 146, 148 in the top panel 20 are selected to generally conform to the periphery of a cylindrical can. The differing heights that the first and second display receptacles 101, 131 provide the containers C allow for different display effects for the carton 190.

Figure 10:
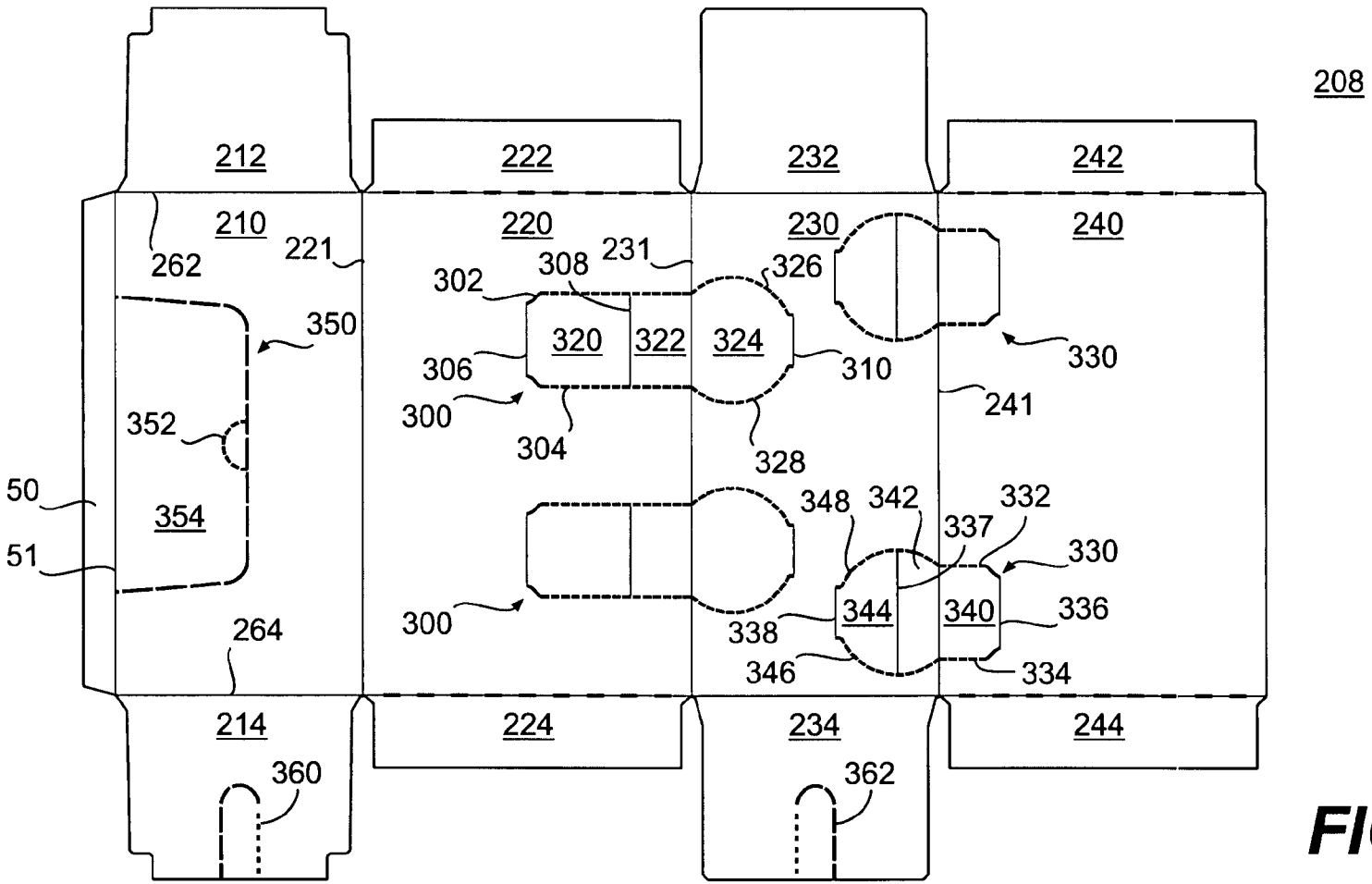
FIG. 10 is a plan view of a blank used to form a carton having display features according to a second embodiment of the invention.

FIG. 10 is a plan view of a blank 208 used to form a carton 390 (illustrated in FIGS. 11 and 12) according to a second embodiment of the invention. The blank 208 comprises a bottom panel 210 foldably connected to a first side panel 220 at a first transverse fold line 221, a top panel 230 foldably connected to the first side panel 220 at a second transverse fold line 231, and a second side panel 240 foldably connected to the top panel 230 at a third transverse fold line 241. An adhesive flap 250 may be foldably connected to the first side panel 210 at a fifth transverse fold line 251. The bottom panel 210 is foldably connected to bottom end flaps 212, 214. The first side panel 220 is foldably connected to first side end flaps 222, 224. The top panel 230 is foldably connected to top end flaps 232, 234. The second side panel 240 is foldably connected to second side end flaps 242, 244.

When the carton 390 is erected, the end flaps 212, 222, 232, 242 close a first end of the carton 390, and the end flaps 214, 224, 234, 244 close a second end of the carton 390. The end flaps 232, 222, 232, 242 extend along a first marginal area of the blank 208, and may be foldably connected at a first longitudinally extending fold line 262 that extends along the length of the blank 208. The end flaps 214, 224, 234, 244 extend along a second marginal area of the blank 208, and may be foldably connected at a second longitudinally extending fold line 264 that extends along the length of the blank 208. The longitudinally extending fold lines 262, 264 may be substantially straight and parallel to one another. The longitudinal fold lines 262, 264 may also be offset at one or more locations to account for blank thickness or for other factors, for example.

Figure 11:
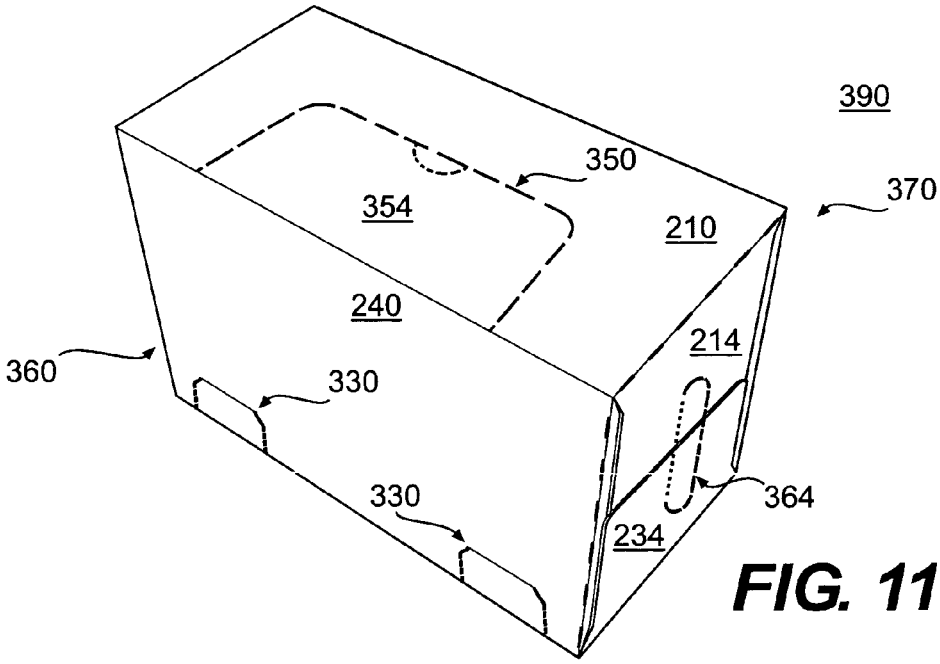
FIGS. 11 and 12 illustrate the erected carton according to the second embodiment of the invention.
Figure 12:
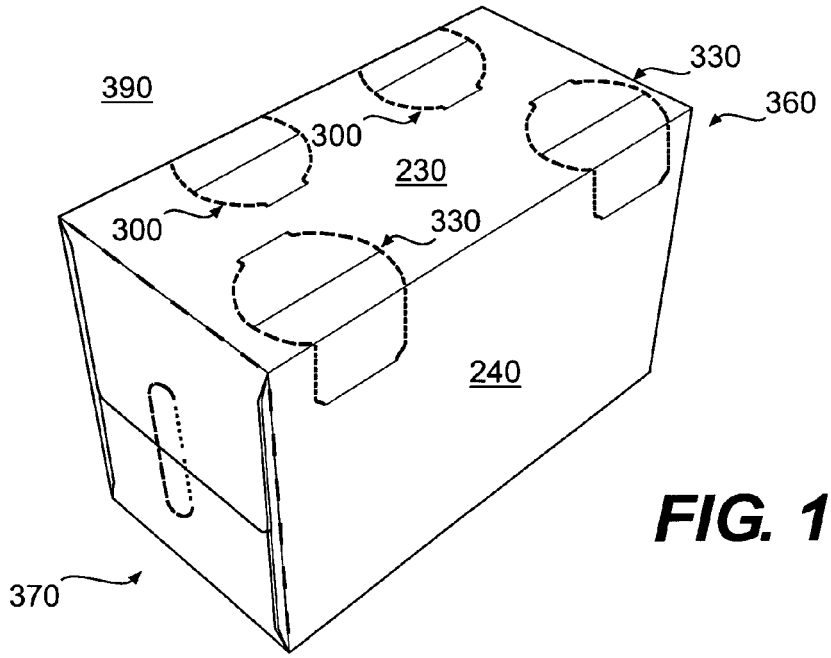

The carton blank 208 includes a dispenser pattern 350 that may be used to dispense articles from the erected carton 390 (illustrated in FIGS. 11 and 12). The dispenser pattern 350 can include an access feature 352 that allows a user to begin opening of the dispenser pattern 350. The dispenser pattern 350 defines a dispenser panel 354 primarily in the bottom panel 210. The dispenser pattern 350 is exemplary, and other dispenser patterns may be employed in cartons according to the present invention. Handle sections 360, 362 may be formed in the end flaps 214, 234, respectively, by tear lines, cut lines, or other lines of disruption. The handle sections 360, 362 cooperate to form a handle 364 (illustrated in FIGS. 11 and 12) in the erected carton 390.

According to one aspect of the present invention, the carton 390 includes a plurality of display features defined by first and second display patterns 300, 330 in the blank 208. The blank 208 is illustrated as having two first display patterns 300 aligned generally along the first side panel 220 and top panel 230, and two second display patterns 330 aligned generally along the second side panel 240 and top panel 230. The first and second display patterns 300, 330 can be placed in a display configuration that allows articles to be mounted in and displayed at the exterior of the carton 390.

The first display patterns 300 extend through the first side panel 220 and the top panel 230. The first display patterns 300 comprise first side tear lines 302, 304 that define sides of the display patterns 300 in the first side panel 220. The first side tear lines 302, 304 continue and extend to curved side tear lines 326, 328 in the top panel 230, respectively. Transverse fold lines 306, 308, 231, 310 divide the first display patterns 300 into foldably connected display panels 320, 322, 324. The display panels 320, 322, 324 serve to support an article when the first display patterns 300 are placed in a display configuration.

The second display patterns 330 extend through the second side panel 240 and the top panel 230. The second display patterns 330 comprise second side tear lines 332, 334 that define sides of the second display patterns 330 in the second side panel 240. The second side tear lines 332, 334 continue and extend to curved side tear lines 348, 346 in the top panel 230, respectively. Transverse fold lines 336, 241, 337, 338 divide the display patterns 330 into foldably connected second display panels 340, 342, 344. The second display panels 340, 342, 344 serve to support an article when the second display patterns 330 are placed in a display configuration.

The tear lines 302, 304, 326, 328, 332, 334, 346, 348 may be, for example, cuts or tear lines formed from a series of cuts and/or scores, offset cut/space lines, combinations thereof, and other breachable lines of disruption formed in the blank 208. The tear lines are formed to allow the display panels to be pressed into an interior of the erected carton 390. The fold lines 221, 231, 241, 251, 306, 308, 310, 336, 337, 338 may be, for example, fold lines formed from creases, cuts, scores, and combinations thereof.

FIGS. 11 and 12 illustrate the erected carton 390 loaded with containers C (not shown). In the second embodiment, the carton 390 is illustrated as enclosing beverage can containers C. In the erected carton 390, the end flaps 212, 222, 232, 242 form a first end panel 360 and the end flaps 214, 224, 234, 244 form a second end panel 370. The dispenser pattern 350 defines the dispenser panel 354 in the bottom panel 210. The first display patterns 300 extend along the top panel 230 and the first side panel 220, and the second display patterns 330 extend along the top panel 230 and the second side panel 240. The first display patterns 300 are generally offset from the second display patterns 330 in the length direction of the carton 390, although other arrangements are within the scope of the present invention. The handle sections 360, 362 (illustrated in FIG. 10) cooperate to form a handle 364 in the second end panel 370.

Figure 13:
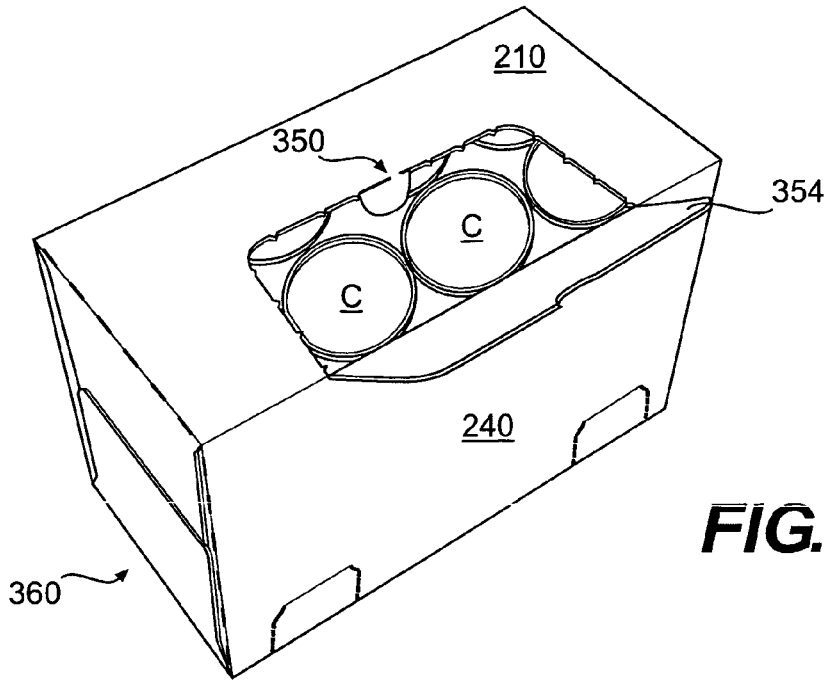
FIG. 13 illustrates an open dispensing feature of the second carton embodiment.
Figure 14:
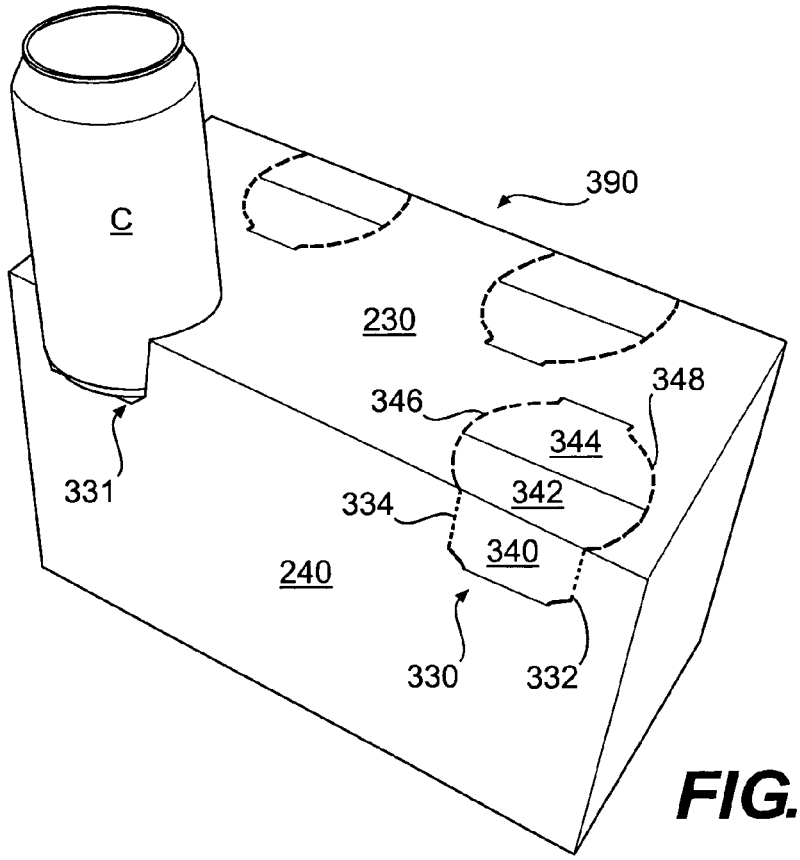
FIGS. 14 and 15 illustrate the second carton embodiment with one display feature in a display configuration and with a container mounted in the display feature.
Figure 15:
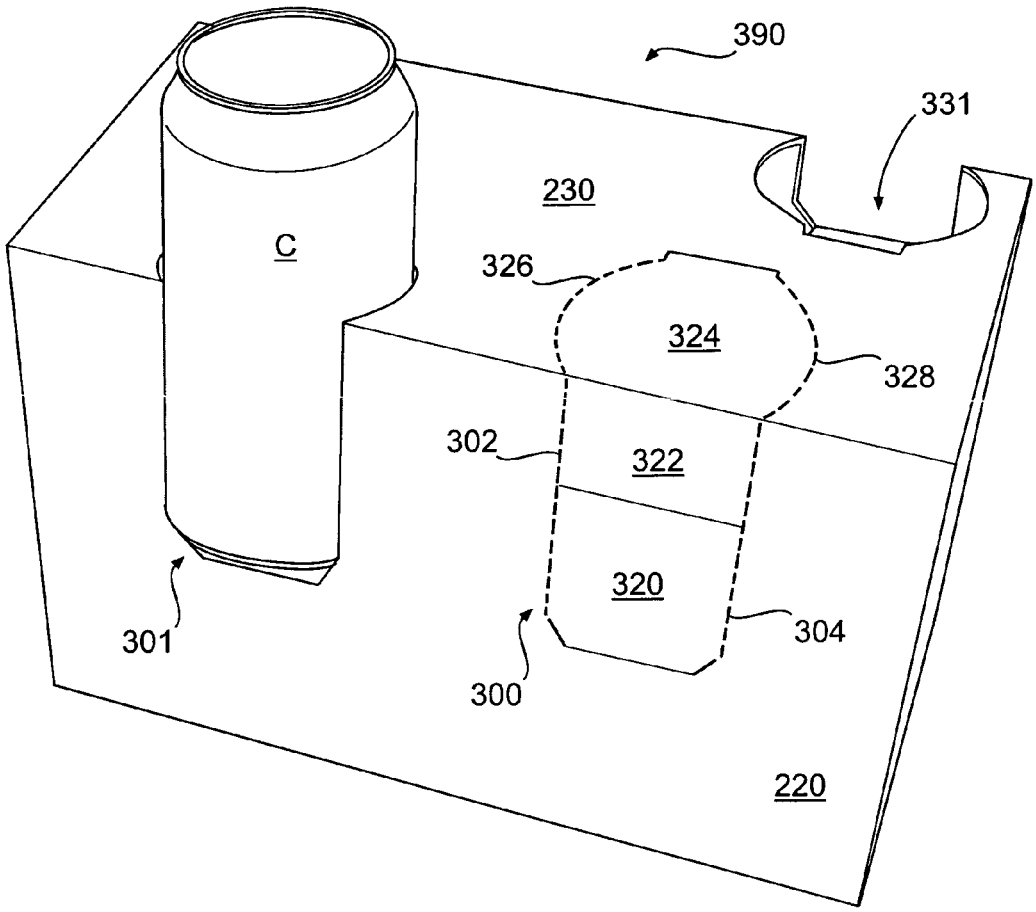

An example of placement of the carton 390 in a display configuration will now be discussed below with reference to FIGS. 13-15. Referring to FIG. 13, in order to place the carton 390 in a display configuration, the carton 390 may first be opened at the dispenser pattern 350 and one or more of the containers C held within the carton removed. FIG. 14 illustrates one of the containers C mounted in a display receptacle 331 formed from a second display pattern 330 that has been placed in the display configuration. A second display pattern 330 may be placed in the display configuration by pressing downwardly within the periphery of the pattern 330 to tear the pattern along any or all of the tear lines 332, 334, 346, 348. FIG. 15 illustrates one of the containers C mounted in a display receptacle 301 formed from a first display pattern 300 that has been placed in a display configuration.

The peripheries of the display receptacles 301, 331 can be relatively conforming to the contours of the containers C. The differing heights that the first and second display receptacles 301, 331 provide the containers C allow for different display effects for the carton 390.

For purposes of illustration, the present invention is disclosed in the context of paperboard cartons sized and dimensioned to contain cylindrical beverage cans. The cartons illustrated in the drawing figures are sized to accommodate articles in a two row configuration, although the present invention is not limited to any specific size or dimension. For example, the present invention would work satisfactorily if sized and shaped to hold articles in alternative arrangements, such as 3×4, 4×3, 2×4, 2×5, 4×6, 4×5, 3×6, 5×6, etc. The present invention can also be used in cartons that include various features, including additional opening features that provide easy access to the articles, and tilt or elevation features that position the articles at the front end of the carton.

In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the display features to function at least generally as described above. The blanks can also be laminated to or otherwise adhered to one or more sheet-like materials at selected panels or panel sections.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier column, on either or both sides of the blanks.

In accordance with the above-described embodiments of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

The above embodiments may be described as having one or panels adhered together by glue during erection of the carton embodiments. The term "glue" is intended to encompass all manner of adhesives commonly used to secure carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A blank for forming a carton, comprising:

a first side panel having opposite first and second edges;

a top panel foldably connected to the first edge of the first side panel;

a second side panel having opposite first and second edges, the top panel being foldably connected to the first edge of the second side panel;

a bottom panel;

at least one first end flap extending along a first marginal area of the blank;

at least one second end flap extending along a second marginal area of the blank; and a plurality of display patterns, including a first display pattern defined in at least the top panel and the first side panel, and a second display pattern defined in at least the top panel and the second side panel, wherein the first display pattern defines at least one first side display panel in the first side panel and at least one first top display panel in the top panel, the first side display panel is foldably connected to the first top display panel, the first side display panel is at least partially separable from the first side panel along a portion of the first display pattern, and foldably connected to the first side panel at a first fold line that is positioned between, and spaced apart from, the first and second edges of the first side panel, so that the first fold line is spaced apart from the first edge of the first side panel by a first distance that extends in a direction, the first top display panel is at least partially separable from the top panel along a portion of the first display pattern, and foldably connected to the top panel at a second fold line that is distant from the first edge of the first side panels, the second display pattern defines at least one second side display panel in the second side panel and at least one second top display panel in the top panel, the second side display panel is foldably connected to the second top display panel, the second top display panel is at least partially separable from the top panel along a portion of the second display pattern, and foldably connected to the top panel at a third fold line that is distant from the first edge of the second side panel, the second side display panel is at least partially separable from the second side panel along a portion of the second display pattern, and foldably connected to the second side panel at a fourth fold line that is positioned between, and spaced apart from, the first and second edges of the second side panel, so that the fourth fold line is spaced apart from the first edge of the second side panel by a second distance that extends in the direction, and the first distance, which is between the first fold line and the first edge of the first side panel, is greater than the second distance, which is between the fourth fold line and the first edge of the second side panel.

2. The blank of claim 1, wherein the first display pattern comprises lines of disruption extending in the first side panel and the top panel.

3. The blank of claim 1, wherein the first side display panel comprises two foldably connected side display panels.

4. The blank of claim 2, wherein the lines of disruption comprise two spaced lines of disruption in the first side panel.

5. The blank of claim 2, wherein the lines of disruption comprise two spaced curved lines of disruption in the top panel.

6. The blank of claim 1, further comprising a dispenser pattern at least partially formed in the bottom panel.

7. The blank of claim 1, wherein:

the first display pattern defines a second side display panel in the first side panel, the second side display panel is positioned between the first side display panel and the first top display panel, and the first side display panel is foldably connected to the first top display panel by way of the second side display panel.

8. A carton, comprising:

a top panel having opposite first and second edges;

a first side panel having opposite top and bottom edges, the top edge being adjacent to the first edge of the top panel;

a second side panel having opposite top and bottom edges, the top edge of the second side panel being adjacent to the second edge of the top panel;

a bottom panel adjacent to both the bottom edge of the first side panel and the bottom edge of the second side panel;

a first end panel at a first end of the carton;

a second end panel at a second end of the carton; and a plurality of display patterns, including a first display pattern defined in at least the top panel and the first side panel, and a second display pattern defined in at least the top panel and the second side panel, wherein the first display pattern defines a first plurality of display panels that are foldably connected to one another and at least partially separable from a remainder of the carton along the first display pattern to form at least one first display receptacle so that the first plurality of display panels extends into an interior of the carton and defines a first support surface of the first display receptacle, a first end of the first plurality of display panels is foldably connected to the first side panel at a first fold line that is positioned between, and spaced apart from, the top and bottom edges of the first side panel, so that the first fold line is spaced apart from the bottom edge of the first side panel, a second end of the first plurality of display panels is foldably connected to the top panel at a second fold line, the second display pattern defines a second plurality of display panels that are foldably connected to one another and at least partially separable from the remainder of the carton along the second display pattern to form at least one second display receptacle so that the second plurality of display panels extends into the interior of the carton and defines a second support surface of the second display receptacle, a first end of the second plurality of display panels is foldably connected to the top panel at a third fold line, a second end of the second plurality of display panels is foldably connected to the second side panel at a fourth fold line that is positioned between, and spaced apart from, the top and bottom edges of the second side panel, so that the fourth fold line is spaced apart from the bottom edge of the second side panel, and a minimum distance between the first fold line and the bottom edge of the first side panel is less than a minimum distance between the fourth fold line and the bottom edge of the second side panel.

9. The carton of claim 8, wherein the first plurality of display panels comprises:

a first side display panel in the first side panel; and a first top display panel in the top panel, wherein the first side display panel is at least partially separable from the first side panel along a portion of the first display pattern, and the first top display panel is at least partially separable from the top panel along a portion of the first display pattern.

10. The carton of claim 9, wherein the first display pattern is defined by breachable lines of disruption in the first side panel and the top panel.

11. The carton of claim 10, wherein the first side display panel is foldably connected to the first top display panel.

12. The carton of claim 11, wherein the first side display panel is foldably connected to the first side panel at the first fold line, and the first top display panel is foldably connected to the top panel at the second fold line.

13. The carton of claim 12, wherein the first side display panel comprises two foldably connected first side display panels.

14. The carton of claim 12, wherein the lines of disruption comprise two spaced lines of disruption in the first side panel and two spaced curved lines of disruption in the top panel.

15. The carton according to claim 8 in combination with a plurality of beverage containers within the carton, wherein the carton is substantially parallelepipedal.

16. The carton according to claim 8 in combination with a plurality of containers including a first container and a second container, wherein:

the first plurality of display panels is partially separated from the remainder of the carton and extends into the interior of the carton so that the first display receptacle, including the first support surface, is defined;

the second plurality of display panels is partially separated from the remainder of the carton and extends into the interior of the carton so that the second display receptacle, including the second support surface, is defined;

the first container is in the first display receptacle and upon the first support surface;

the second container is in the second display receptacle and upon the second support surface; and a top of the first container is at a lower elevation than a top of the second container as a result of the minimum distance between the first fold line and the bottom edge of the first side panel being less than the minimum distance between the fourth fold line and the bottom edge of the second side panel.

17. The blank of claim 16, further comprising at least one second display pattern defined in at least the top panel and the second side panel, wherein:

the second display pattern defines at least one second side display panel in the second side panel and at least one second top display panel in the top panel, the second side display panel is at least partially separable from the second side panel along a portion of the second display pattern, and the second top display panel is at least partially separable from the top panel along a portion of the second display pattern.

18. A blank for forming a carton, comprising:

a top panel having opposite first and second edges;

a first side panel having opposite first and second edges, wherein the first edge of the first side panel is foldably connected to the first edge of the top panel by a first fold line;

a second side panel;

a bottom panel; and a display pattern defined in at least the top panel and the first side panel, wherein the display pattern defines at least first and second side display panels in the first side panel, and at least one top display panel in the top panel, the second side display panel is positioned between the first side display panel and the first top display panel, the top display panel is at least partially separable from the top panel along a portion of the display pattern, the top display panel is foldably connected to the top panel at a second fold line that is distant from the first edge of the top panel, the first and second side display panels are at least partially separable from the first side panel along a portion of the display pattern, the first side display panel is foldably connected to a portion of the blank at a third fold line that is distant from the first edge of the first side panel, and the second side display panel is foldably connected to the top display panel at the first fold line, and the first side display panel is foldably connected to the second side display panel at a fourth fold line positioned between and distant from each of the first and third fold lines.

19. The blank of claim 18, wherein the first side display panel is foldably connected to the first side panel at the third fold line that is distant from each of, and positioned between, the first and second edges of the first side panel.

20. The blank of claim 18, wherein:

the top display panel has first and second arcuate edges that are opposite from one another, and the second fold line, by way of which the top display panel is foldably connected to the top panel, is positioned between the first and second arcuate edges of the top display panel.

21. A blank for forming a carton, comprising:

a first side panel having opposite first and second edges;

a top panel having opposite first and second edges that extend away from an end of the top panel, the first edge of the top panel being foldably connected to the first edge of the first side panel;

a second side panel having opposite first and second edges, the second edge of the top panel being foldably connected to the first edge of the second side panel;

a bottom panel;

a plurality of first display patterns, wherein for each first display pattern of the plurality of first display patterns the first display pattern is defined in the top panel and the first side panel, the first display pattern defines at least one first side display panel in the first side panel and at least one first top display panel in the top panel, the first side display panel is foldably connected to the first top display panel, the first side display panel is at least partially separable from the first side panel along a portion of the first display pattern, and the first side display panel is foldably connected to a portion of the blank at a fold line that is distant from the first edge of the first side panel, the first top display panel is at least partially separable from the top panel along a portion of the first display pattern, and the first top display panel is foldably connected to the top panel at a fold line that is distant from the first edge of the first side panel;

a plurality of second display patterns, wherein for each second display pattern of the plurality of second display patterns the second display pattern is defined in the top panel and the second side panel, the second display pattern defines at least one second side display panel in the second side panel and at least one second top display panel in the top panel, the second side display panel is foldably connected to the second top display panel, the second side display panel is at least partially separable from the second side panel along a portion of the second display pattern, and the second side display panel is foldably connected to a portion of the blank at a fold line that is distant from the first edge of the second side panel, the second top display panel is at least partially separable from the top panel along a portion of the second display pattern, and the second top display panel is foldably connected to the top panel at a fold line that is distant from the first edge of the second side panel; and the plurality of first display patterns being offset with respect to the plurality of second display patterns along a length of the blank, so that a minimum distance between the plurality of first display patterns and the end of the top panel is different than a minimum distance between the plurality of second display patterns and the end of the top panel.

22. The blank of claim 21, wherein for each first display pattern of the plurality of first display patterns:

the first display pattern defines a second side display panel in the first side panel, the second side display panel is positioned between the first side display panel and the first top display panel, and the first side display panel is foldably connected to the first top display panel by way of the second side display panel.

23. The blank of claim 22, wherein for each second display pattern of the plurality of second display patterns, the second side display panel is directly foldably connected to the second top display panel.

24. A carton, comprising:

a top panel having opposite first and second edges;

a first side panel having opposite top and bottom edges, wherein the top edge of the first side panel is foldably connected to the first edge of the top panel by a first fold line;

a second side panel adjacent to the second edge of the top panel;

a bottom panel adjacent to both the bottom edge of the first side panel and the bottom side panel; and a display pattern defined in at least the top panel and the first side panel, wherein the display pattern defines a plurality of display panels that are foldably connected to one another and at least partially separable from a remainder of the carton along the display pattern to form at least one display receptacle so that the plurality of display panels extends into an interior of the carton and defines a support surface of the display receptacle, the plurality of display panels includes at least one top display panel in the top panel, and at least first and second side display panels in the first side panel, the second side display panel is positioned between the first side display panel and the top display panel, the top display panel is foldably connected to the top panel at a second fold line that is distant from each of, and between, the first and second edges of the top panel, the first side display panel is foldably connected to a portion of the carton at a third fold line that is distant from the top edge of the first side panel, and the second side display panel is foldably connected to the top display panel at the first fold line, and the first side display panel is foldably connected to the second side display panel at a fourth fold line positioned between, and distant from, each of the first and third fold lines.

25. The carton of claim 24, wherein the first side display panel is foldably connected to the first side panel at the third fold line, and the third fold line is distant from each of, and positioned between, the top and bottom edges of the first side panel.

26. A carton, comprising:

a top panel having opposite first and second edges that extend away from an end of the carton;

a first side panel having opposite top and bottom edges, the top edge being adjacent to the first edge of the top panel;

a second side panel having opposite top and bottom edges, the top edge of the second side panel being adjacent to the second edge of the top panel;

a bottom panel adjacent to both the bottom edge of the first side panel and the bottom edge of second side panel;

a plurality of first display patterns, wherein for each first display pattern of the plurality of first display patterns the first display pattern is defined in at least the top panel and the first side panel, the first display pattern defines a first plurality of display panels that are foldably connected to one another and at least partially separable from a remainder of the carton along the first display pattern to form at least one display receptacle so that the first plurality of display panels extends into an interior of the carton and defines a support surface of the first display receptacle, a first end of the first plurality of display panels is foldably connected to the top panel at a first fold line that is positioned between, and spaced apart from, the first and second edges of the top panel, a second end of the first plurality of display panels is foldably connected to the remainder of the carton at a second fold line;

a plurality of second display patterns, wherein for each second display pattern of the plurality of second display patterns the second display pattern is defined in at least the top panel and the second side panel, the second display pattern defines a second plurality of display panels that are foldably connected to one another and at least partially separable from a remainder of the carton along the second display pattern to form at least one display receptacle so that the second plurality of display panels extends into the interior of the carton and defines a support surface of the second display receptacle, a first end of the second plurality of display panels is foldably connected to the top panel at a third fold line that is positioned between, and spaced apart from, the first and second edges of the top panel, a second end of the second plurality of display panels is foldably connected to the remainder of the carton at a fourth fold line; and the plurality of first display patterns being offset with respect to the plurality of second display patterns along a length of the carton, so that a minimum distance between the plurality of first display patterns and the end of the carton is different than a minimum distance between the plurality of second display patterns and the end of the carton.

* * * * *